United States Patent [19]

Ishii et al.

[11] Patent Number: 4,914,447

[45] Date of Patent: Apr. 3, 1990

[54] ANTENNA FOR MOBILE TELEPHONE ON A GLASS PANEL OF AN AUTOMOBILE

[75] Inventors: Kenichi Ishii; Kouji Tabata, both of Chita, Japan

[73] Assignee: Asahi Glass Company, Ltd., Tokyo, Japan

[21] Appl. No.: 311,390

[22] Filed: Feb. 16, 1989

Related U.S. Application Data

[63] Continuation of Ser. No. 122,450, Nov. 19, 1987, abandoned.

[30] Foreign Application Priority Data

Nov. 21, 1986 [JP] Japan ..... 61-179304

[51] Int. Cl.[4] ..... H01Q 1/32

[52] U.S. Cl. ..... 343/713

[58] Field of Search ..... 343/713

[56] References Cited

U.S. PATENT DOCUMENTS

| | | | |
|---|---|---|---|
| 4,260,989 | 4/1981 | Ishii | 343/713 |
| 4,329,691 | 5/1982 | Prewitt | 343/713 |
| 4,439,771 | 5/1984 | Kume et al. | 343/713 |
| 4,527,164 | 7/1985 | Cestaro et al. | 343/713 |
| 4,736,206 | 4/1988 | Sakurai et al. | 343/713 |
| 4,746,925 | 5/1988 | Toriyama | 343/713 |
| 4,768,037 | 8/1988 | Inaba et al. | 343/713 |
| 4,791,425 | 12/1988 | Yotsuya et al. | 343/713 |

FOREIGN PATENT DOCUMENTS

| | | | |
|---|---|---|---|
| 0124055 | 11/1984 | European Pat. Off. | 343/713 |
| 0100004 | 5/1986 | Japan . | |
| 0222302 | 10/1986 | Japan . | |
| 0280107 | 12/1986 | Japan . | |

*Primary Examiner*—Rolf Hille
*Assistant Examiner*—Doris J. Johnson
*Attorney, Agent, or Firm*—Oblon, Spivak, McClelland, Maier & Neustadt

[57] ABSTRACT

An antenna system for mobile telephone is arranged on a glass panel, i.e. the rear window glass panel of an automobile. The antenna system comprises a main antenna part comprising a horizontal antenna element, a pair of vertical antenna elements extending vertically from the both ends of the horizontal antenna element, and a first feeding point connected to the free end of one of the vertical antenna elements, an earth line part, provided apart from the main antenna part, which extends in parallel to the horizontal antenna element and which has a second feeding point at an intermediate portion of the earth line part and below the first feeding point, and an auxiliary antenna part which has an extension element extending in parallel to the earth line part and which is connected to either or both of the horizontal antenna element of the main antenna part and the free end of the vertical antenna element connected to the first feeding point.

5 Claims, 4 Drawing Sheets

ANTENNA FOR MOBILE TELEPHONE ON A GLASS PANEL OF AN AUTOMOBILE

This application is a continuation of application Ser. No. 122,450, filed on Nov. 19, 1987, now abandoned.

BACKGROUND OF THE INVENTION

1. Field of the Invention

The present invention relates to an antenna for mobile telephone on a glass panel of an automobile.

2. Discussion of Background

In recent years, there has been a steady increase in demand for mounting a telephone on an automobile so that a passenger communicates through telephone during movement.

For the mobile telephone, radio waves of the frequency band ranging 820 MHz–980 MHz, especially, 860 MHz–940 MHz have been used, and for antennas to receive and transmit the radio waves, pole antennas have been generally used. The pole antenna is mounted on an automobile to project in a rod form from the car body to obtain practical radio wave-receiving and transmitting properties. The pole antenna had, however, disadvantages that the antenna as a projection produces uncomfortable whistling sound during cruising, and the appearance of the automobile is impaired. Further, the pole antenna may injure a walking person, and it may be broken during parking of the automobile.

SUMMARY INVENTION

It is an object of the present invention to provide an antenna for mobile telephone for an automobile which provides the same antenna gain as a conventional pole antenna.

The foregoing and the other objects of the present invention have been attained by providing an antenna for mobile telephone on a glass panel of an automobile which comprises:

a main antenna part comprising a substantially horizontal antenna element, a pair of substantially vertical antenna elements respectively extending vertically from the both ends of said horizontal antenna element, and a first feeding point connected to the free end of one of said vertical antenna elements, an earth line part, provided apart from said main antenna part, which extends in substantially parallel to said horizontal antenna element and which has a second feeding point at an intermediate portion of the earth line part and below said first feeding point, and an auxiliary antenna part which has an extension element extending in substantially parallel to said earth line part and which is connected to either or both of said horizontal antenna element of the main antenna part and said free end of the vertical antenna element connected to said first feeding point, said main and auxiliary antenna parts and said earth line part being arranged on said glass panel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
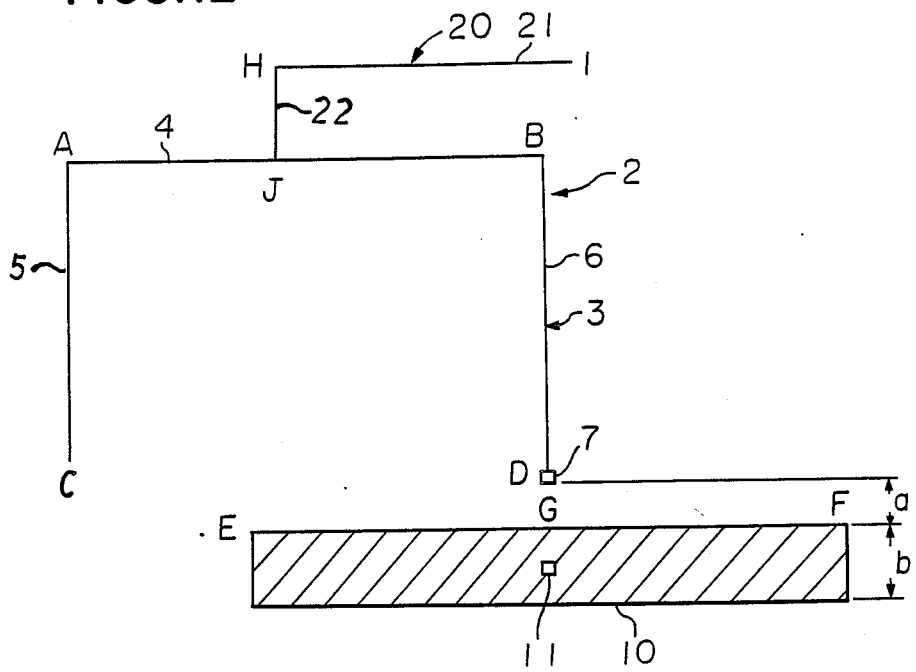
FIG. 1 is a front view of an embodiment of the antenna for mobile telephone according to the present invention.

Preferred embodiments of the present invention will be described with reference to the drawings, wherein the same reference numerals designate the same or corresponding parts throughout the several views. An antenna conductor 2 having a suitable pattern which shows a good antenna gain to radio waves of the frequency band in the range of 820 MHz–980 MHz, especially, 860 MHz–940 MHz, is arranged, as an antenna for mobile telephone on a glass panel 1 such as the rear glass window, a side glass window or a windshield glass window of an automobile.

FIG. 1 shows an example of the pattern of the antenna conductor 2. The antenna conductor 2 has a main antenna part 3 which comprises substantially horizontal (or lateral) antenna element 4 and a pair of substantially vertical (or longitudinal) antenna elements 5, 6 respectively extending in the substantially vertical (or longitudinal) direction from the both ends (or the vicinity of the both ends) of the horizontal antenna element 4. A first feeding point 7 is provided at the free end (or the vicinity of the free end) of either of the vertical antenna elements in the embodiment shown in FIG. 1 to connect a feeder line.

In the description, the terms "substantially horizontal" and "substantially vertical" refer to the directions of the antenna elements when they are mounted on or fitted in a glass panel.

An earth line part 10 is located below the free end of the vertical antenna element 6 to which the first feeding point 7 is connected. An intermediate point is given in the earth line part 10 at a position just below the free end of the vertical antenna element 6, and a second feeding point 11 is located at the intermediate point to which a feeder line for grounding is connected.

An auxiliary antenna part 20 comprises an extension element 21 which extends in substantially parallel to the horizontal antenna element 4 of the main antenna part 3, and a vertical line portion 22 connecting an end of the extension element 21 to the horizontal antenna element 4 at a suitable position. In FIG. 1, the auxiliary antenna part 20 is in an inverse-L shape. However, the auxiliary antenna part 20 may be in a shape of aT.

Of the antenna conductor 2 having the above-mentioned pattern, it is desirable that a segment of line A-C of the vertical antenna element 5, a segment of line B-D of the vertical antenna element 6 in the main antenna part 3, segments of line E-G and F-G which are divided by the second feeding point 11 in the earth line part 10, and a segment of line H-I of the extension element 21 in the auxiliary antenna part 20 are respectively determined by $(\lambda/4)\alpha$($\alpha$: reduction factor of a wavelength for a glass antenna, e.g. $\alpha \approx 0.6$) where $\lambda$ is a predetermined wavelength.

Figure 3:
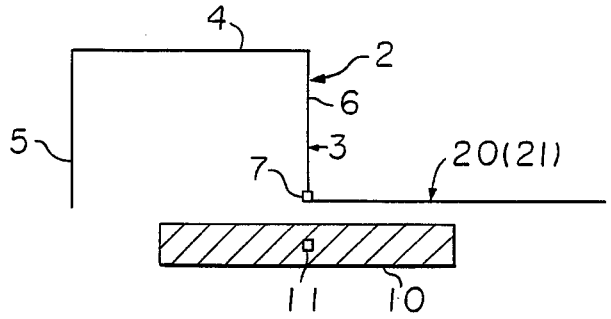
FIG. 3 is a front view of a second embodiment of the present invention.

FIGS. 3 to 5 and 8 to 9 respectively show the second to sixth embodiments of the antenna conductor 2 according to the present invention. In FIG. 3, the auxiliary antenna part 20 is formed by connecting an extension element 21 to the free end of the vertical antenna element 6 having the first feeding point 7 in the main antenna part 3. In this case, the auxiliary antenna part 20 is not connected to the horizontal antenna element 4.

Figure 4:
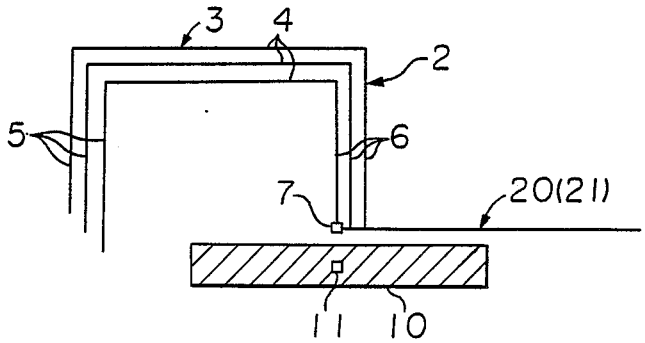
FIG. 4 is a front view of a third embodiment of the present invention.

In the third embodiment shown in FIG. 4, the main antenna part 3 is constituted by three sets of the horizontal antenna element and the paired vertical antenna elements 5, 6, each of the sets being spaced apart a predetermined distance in a parallel relation. The auxiliarly antenna part 20 comprises the extension element 21 connected to the first feeding point 7 which is provided at the free end of the vertical antenna element 6, and is connected to each free end of the vertical antenna elements 6, 6 lying outside the innermost vertical antenna element 6.

Figure 5:
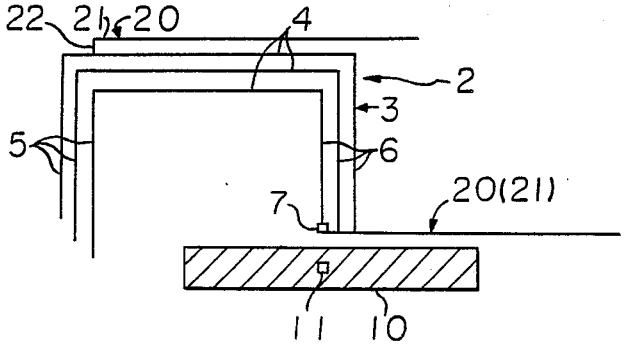
FIG. 5 is a front view of a fourth embodiment of the present invention.

In the fourth embodiment shown in FIG. 5, an additional auxiliary antenna part 20 is connected to the outermost horizontal antenna element 4 through a vertical line 22 so that the extension element 21 extends in parallel to the horizontal antenna element 20.

Figure 8:
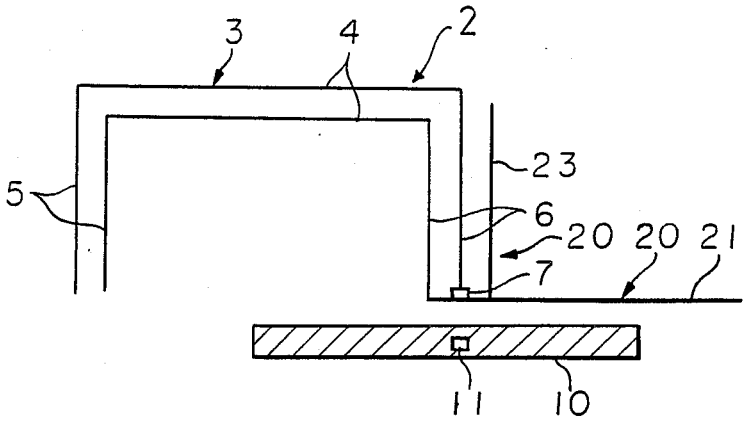
FIG. 8 is a front view of a fifth embodiment of the present invention.

The fifth embodiment shown in FIG. 8 has such a construction that the main antenna part 3 comprises two sets of the horizontal antenna element 4 and the paired vertical antenna elements 5, 6, the two sets being spaced apart in parallel to each other with a predetermined distance, and the auxiliary antenna part 20 is constituted by an extension element 21 extending from the first feeding point 7 in parallel to the earth line part 10 and a vertical extension element 23 which extends in the substantially vertical direction from a point on the extension element 21.

Figure 9:
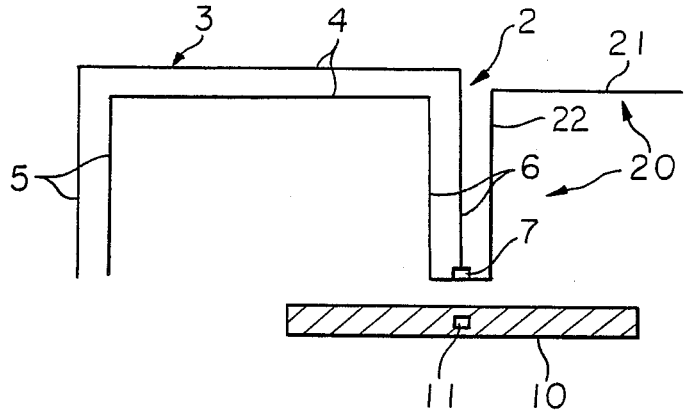
FIG. 9 is a front view of the sixth embodiment of the present invention.

The sixth embodiment shown in FIG. 9 has such a construction that the main antenna comprises two sets of the horizontal antenna element 4 and the paired vertical antenna elements 5, 6, the two sets being spaced apart in parallel to each other with a predetermined distance, and the auxiliary antenna part 20 is constituted by a vertical extension element 22 extending from the first feeding point 7 and a horizontal extension element 21 extending from the free end of the vertical extension element 22 in parallel to the horizontal antenna element 4.

In the present invention, when the antenna conductor 2 is provided in the glass panel 1 which is a laminated glass, it may be provided on either face of the glass to be bonded, or on the surface of the glass panel facing the inside of the automobile, or facing the outside of it. Alternatively, the antenna conductor may be embedded in an interlayer of the laminated glass. When the glass panel 1 is a tempered glass having a single plate structure, the antenna conductor 2 may be provided on the glass panel facing the inside or the outside of the automobile.

In the antenna conductor 2 of the present invention, modification of the antenna conductor 2 can be made by reversing the glass antenna patterns, as shown in FIGS. 1, 3, 4, 5, 8 and 9 on the glass panel 1 depending on the condition of arrangement of the glass panel 1.

Figure 2:
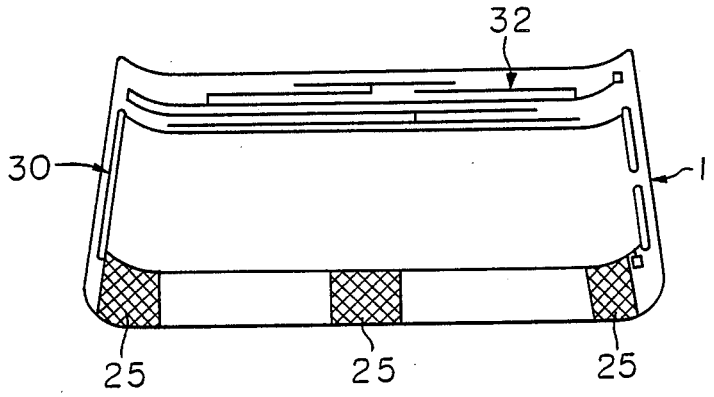
FIG. 2 is a front view of a glass panel in which an antenna for mobile telephone of the present invention may be provided.

FIG. 2 shows an example that the antenna conductor 2 may be arranged at the central, the right or the left region 25 in the lower part of the glass panel 1 which may be the rear glass window in which an antifogging device 30 and an antenna conductor 32 for receiving electromagnetic waves or for radio television are provided. The position and the number of the antenna conductor 2 can be desirebly selected in consideration of antenna gain. Further, the antenna conductor can be provided in any glass panel such as a side glass panel or a windshield glass panel other than the rear glass window panel.

The antenna conductor 2 to be formed on the glass panel 1 is prepared as follows. Electrically conducting metal powder such as Ag, Al, Pd or powder of another kind of electrically conducting material is mixed with glass frit, a vehicle and an additive, if necessary, to prepare a paste of electrically conducting substance; the paste is formed on a glass panel by a printing technique in a predetermined linear pattern; and the printed linear patter is sintered to form an electrically conducting line. Alternatively, the antenna conductor 2 may be formed by a suitable electrically conducting fine wire or strip such as a copper wire or an electrically conducting metal foil such as a copper foil.

Experiments were conducted to confirm performance of the antenna for mobile telephone of the present invention.

EXPERIMENT

An antenna conductor 2 having the pattern shown in FIG. 1 was formed on a glass panel 1. The dimensions of each antenna element is as follows. A copper foil having a width of 0.7 mm–1.0 mm was used for each of the antenna elements.

(1) Main antenna part 3

The horizontal antenna element 4 (A segment of line A-B): 80 mm

The vertical antenna element 5 (a segment of line A-C): 50 mm

The vertical antenna element 6 (a segment of line B-D): 55 mm (2) Earth line part 10 (a segment of line E-F): 100 mm, where segment of lines E-G =F-G: 50 mm (3) Auxiliary antenna part 20

The extension element 21 (a segment of line H-I): 50 mm

The vertical element 22 (a segment of line H-J): 15 mm, where a segment of line A-J: 35 mm In FIG. 1, the distance of a is 7 mm and the distance of b is 12.5 mm.

By using the antenna conductor as specified above, experimental data as shown in Tables 1 and 2 were obtained. Each of the data in Table 1 shows sensitivity of the antenna in the vertical poralized-wave plane, and Table 2 shows sensitivity of the antenna in the horizontal poralized-wave plane.

TABLE 1

| Frequency (MHz) | 860 | 870 | 880 | 890 | 900 | 910 | 920 | 930 | 940 | Average in total |
|---|---|---|---|---|---|---|---|---|---|---|
| Average gain | −6.8 | −7.2 | −5.8 | −5.7 | −5.7 | −6.0 | −4.9 | −3.4 | −4.0 | −5.5 |
| Minimum gain | −25.8 | −29.8 | −22.0 | −23.5 | −27.8 | −25.6 | −37.7 | −32.1 | −29.0 | −28.1 |
| Maximum gain | −1.8 | −2.1 | −0.8 | −0.4 | 0.0 | −0.5 | 1.3 | 2.1 | 1.6 | 0.0 |
| Directivity | 24.0 | 27.7 | 21.2 | 23.1 | 27.8 | 25.1 | 39.0 | 34.2 | 30.6 | 28.1 |

(Unit: dB)

TABLE 2

| Frequency (MHz) | 860 | 870 | 880 | 890 | 900 | 910 | 920 | 930 | 940 | Average in total |
|---|---|---|---|---|---|---|---|---|---|---|
| Average gain | −15.3 | −14.6 | −14.0 | −13.5 | −13.0 | −13.6 | −15.1 | −13.9 | −14.3 | −14.1 |
| Minimum gain | −40.6 | −43.7 | −39.6 | −54.3 | −39.3 | −44.0 | −47.0 | −39.9 | −37.4 | −42.9 |
| Maximum gain | −6.0 | −5.6 | −4.7 | −4.6 | −4.5 | −6.5 | −9.0 | −7.9 | −8.1 | −6.4 |
| Directivity | 34.6 | 38.1 | 34.9 | 49.7 | 34.8 | 37.5 | 38.0 | 32.0 | 29.3 | 36.5 |

(Unit: dB)

Figure 6:
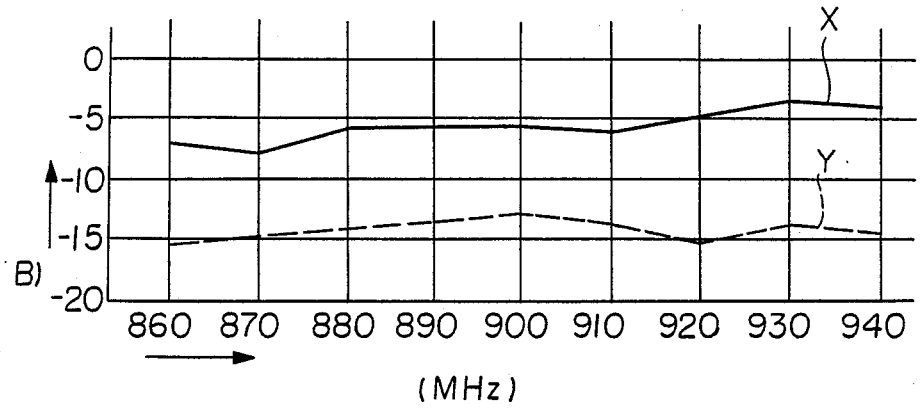
FIG. 6 is a diagram showing a relation of frequencies to average gain obtained by the antenna of the present invention.
Figure 7:
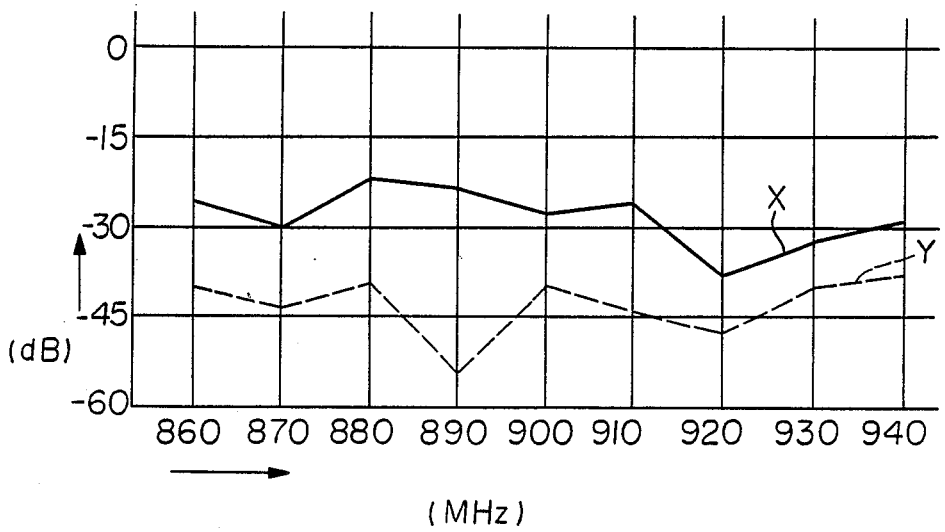
FIG. 7 is a diagram showing a relation of frequencies to the minimum gain obtained by the antenna of the present invention.

FIG. 6 is a graph showing the average gain and FIG. 7 is a graph showing the minimum gain, wherein X represents the vertical poralized-wave plane and Y represents the horizontal poralized-wave plane.

As apparent from the experimental data, the antenna conductor having the antenna pattern provides the same antenna gain as the conventional pole antenna.

Thus, in accordance with the present invention, sensitivity of the antenna to electromagnetic waves of a frequency range of about 820 MHz–980 MHz, especially about 860 MHz–940 MHz which is utilized for mobile telephone is made the same level of antenna gain as the conventional pole antenna. Accordingly, the pole antenna as a projection can be eliminated from the surface of the car body of an automobile, and production of uncomfortable whistling sound can be avoided. Further, the appearance of the automobile is improved. In addition, there is no possibility of injuring a walking person and breaking of the antenna during parking of the automobile.

Obviously, numerous modifications and variations of the present invention are possible in light of the above teachings. It is therefore to be understood that within the scope of the appended claims, the invention may be practiced otherwise than as specifically described herein.

What is claimed is:

1. An antenna for the transmission/reception of radio waves for mobile telephone on a glass panel of an automobile comprising:

a main antenna part comprising a substantially horizontal antenna element, a pair of substantially vertical antenna elements respectively extending vertically from the both ends of said horizontal antenna elements, and a first feeding point connected to the free end of one of said vertical antenna elements, an earth line part, provided apart from said main antenna part, which extends in substantially parallel to said horizontal antenna elements and which has a second feeding point at an intermediate portion of the earth line part and below said first feeding point, and an auxiliary antenna part shaped as an inverted L which has an extension element extending in substantially parallel to said earth line part which is connected to said horizontal antenna element of the main antenna part.

2. The antenna for mobile telephone according to claim 1, wherein the length of said vertical antenna elements, the length of the extension element of said auxiliary antenna part is given by $(\lambda/4)\alpha$($\alpha$: reduction factor of a wavelength for a glass antenna) where $\lambda$ is a predetermined wavelength.

3. The antenna for mobile telephone according to claim 1, wherein said main antenna part is constituted by plural sets of the horizontal antenna element and paired vertical antenna elements, and a free end of each of said plural sets of antenna is connected to said auxiliary antenna part which is connected to said first feeding point.

4. The antenna for mobile telephone according to claim 3, wherein an additional auxiliary antenna part is connected to the horizontal antenna element of an outermost set.

5. The antenna for mobile telephone according to claim 1, wherein the distance between a free end of said earth line part and said second feeding point is given by $(\lambda/4)\alpha$($\alpha$: reduction factor of a wavelength for a glass antenna) where $\lambda$ is a predetermined wavelength.

* * * * *